United States Patent [19]

Ross

[11] 4,305,671

[45] Dec. 15, 1981

[54] AGITATOR FOR AN ELECTROLYTIC SODIUM CELL RECEIVER

[75] Inventor: Francis J. Ross, Niagara Falls, N.Y.

[73] Assignee: E. I. Du Pont de Nemours and Company, Wilmington, Del.

[21] Appl. No.: 111,782

[22] Filed: Jan. 14, 1980

[51] Int. Cl.[3] ..... B01F 7/18; C25C 3/00

[52] U.S. Cl. ..... 366/276; 204/245

[58] Field of Search ..... 204/245, 246, 247, 68; 366/276, 278, 312, 328, 243; 68/132

[56] References Cited

U.S. PATENT DOCUMENTS

| | | | |
|---|---|---|---|
| 210,090 | 11/1878 | Brown | 366/276 X |
| 1,284,816 | 11/1918 | Thompson | 366/328 |
| 1,444,346 | 2/1923 | Kohr | 366/328 X |
| 2,740,282 | 4/1956 | Buchholz | 68/132 |
| 3,523,885 | 8/1970 | Gallinger | 204/245 |
| 4,065,107 | 12/1977 | Van Horbek | 366/276 X |

FOREIGN PATENT DOCUMENTS

| | | | |
|---|---|---|---|
| 949301 | 2/1964 | United Kingdom | 366/328 |

*Primary Examiner*—Philip R. Coe

[57] ABSTRACT

An apparatus for agitating the contents of an electrolytic sodium cell receiver, which apparatus comprises (a) an agitator having a blade portion and a shank portion, the blade portion being fitted within the receiver housing and having three blades extending horizontally and laterally and spaced at about 120° intervals, and the shank portion extending upward out of the receiver housing, and (b) means for imparting reciprocating rotary motion to the agitator.

3 Claims, 2 Drawing Figures

AGITATOR FOR AN ELECTROLYTIC SODIUM CELL RECEIVER

DESCRIPTION

1. Technical Field

This invention relates to an apparatus for agitating the contents of an electrolytic sodium cell receiver. It is more particularly directed to an apparatus which agitates the receiver automatically, with a minimum of human intervention.

2. Background Art

Metallic sodium is ordinarily produced by the electrolysis of a fused salt bath in a cell of the type described by Downs in his U.S. Pat. No. 1,501,756. In such a cell, metallic sodium forms at the cathode and rises through the electrolyte to a collector. From there it flows into a riser pipe which conveys the sodium from the upper part of the cell over a weir and into a receiver. This receiver is periodically emptied through a drain port on the bottom of its housing.

The principal component of the salt bath used in the process is sodium chloride. Because of its high melting point, however, the sodium chloride is generally mixed with calcium chloride, which lowers the melting point of the bath to below the boiling point of sodium and permits the metal to be removed from the cell as a liquid.

When such a mixture is used, metallic calcium is also given off at the cathode. This calcium dissolves in the sodium at cell operating temperatures, but as the resulting alloy flows into the riser pipe and the receiver, its temperature drops and the solubility of the calcium in the sodium is decreased. The calcium precipitates and forms a sticky, gummy mass which is deposted on the sides and bottom of the receiver, thus obstructing flow through the drain port and hindering the draining operation.

It is therefore necessary to mechanically agitate the contents of the receiver periodically to minimize the formation of these deposits. This is ordinarily done with an agitator, which, in the most basic sense, is a blade fitted within the receiver and so mounted that it can be rotated about its central vertical axis. The most common form of agitator is one having two opposed blades projecting laterally from its central vertical axis. Such an agitator is rotated continuously, and while this is generally satisfactory, the formation of deposits on the sides and bottom of the receiver is not hindered so much as is desirable, and the continuous rotary motion generates a vortex in the molten sodium which sometimes spills the sodium over the weir and back into the riser.

In the agitator's simplest form, the rotary motion is manually imparted by a human operator who turns a crank fixed to the blades and positioned at the outside top of the receiver. The environment at the top of an electrolytic sodium cell is sometimes hostile because of the heat and noxious gases and vapors which may leak out. Agitating the contents of the receiver under these conditions is therefore, at best, laborious and uncomfortable for the operator.

Because of all this, there is a real need for an apparatus which can effectively agitate the contents of a receiver without creating a vortex and, most desirable of all, one which can do this automatically and with a minimum of human intervention. This need is filled by the apparatus of the invention.

DISCLOSURE OF THE INVENTION

Figure 1:
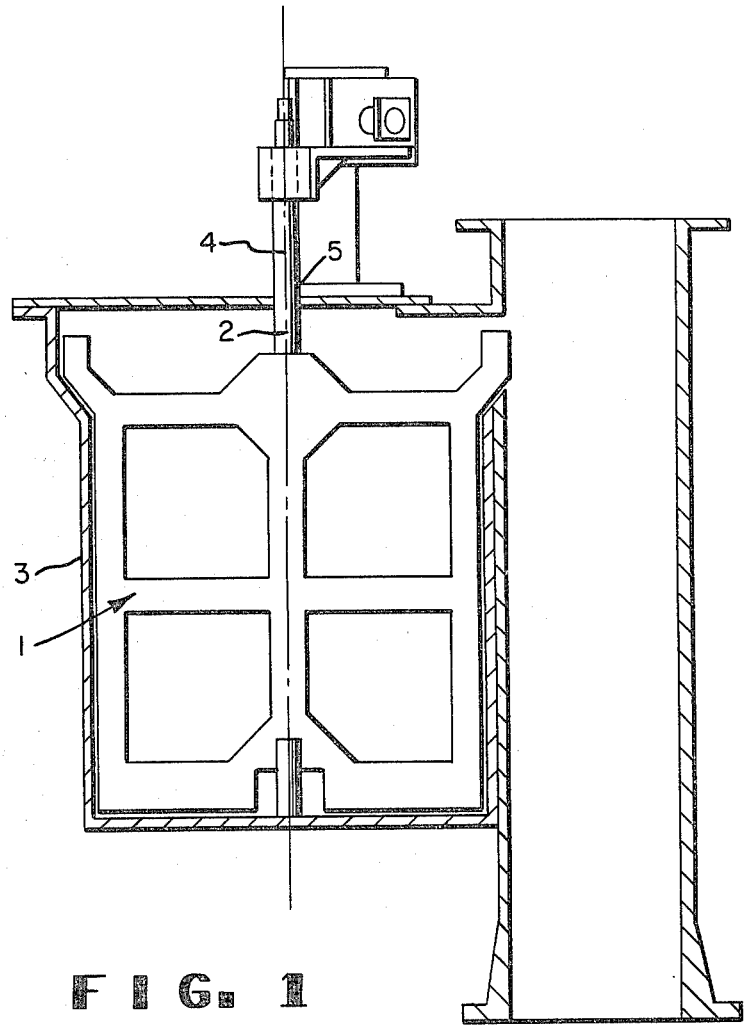
FIG. 1 is a sectional elevational view of the agitator apparatus and its accompanying riser pipe.

One will be better able to understand the apparatus and how it works by referring to the drawings.

In FIG. 1, the agitator is composed of blade portion 1 and shank portion 2. The blade portion is fitted within the receiver housing 3 and is mounted to rotate on its central vertical axis 4. Shank portion 2 extends upward out of the housing at point 5.

Figure 2:
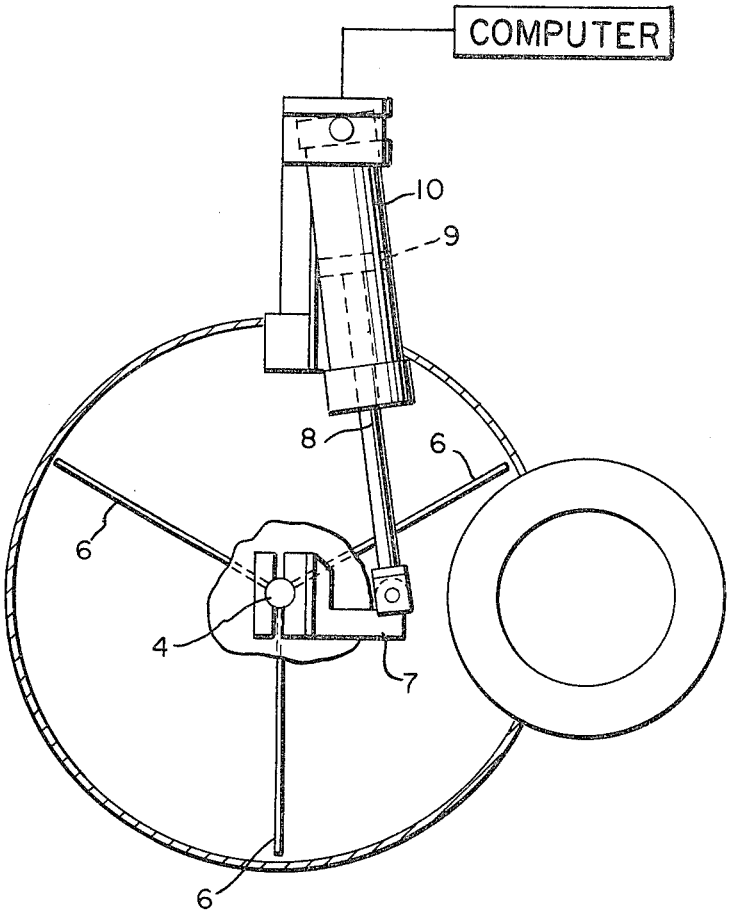
FIG. 2 is a plan view of the agitator apparatus.

As shown in FIG. 2, blade portion 1 has three blades 6 extending laterally and horizontally in planes which pass through its central vertical axis 4. These blades are spaced about the axis at about 120° intervals.

When the apparatus is in operation, blade portion 1, shank 2 and crank 7 (as shown in FIG. 2) are moved reciprocally by pressure applied to shaft 8 by piston 9, which is housed within cylinder 10. The blade portion is moved by this operation through about 121°–125° of arc to ensure stroke overlap and complete wiping of the receiver wall.

In the best mode of the invention, the blades, shank and crank are brought into rotary reciprocal motion by air pressure applied alternately to the front and back sides of piston 9. If desired, this reciprocal motion can also be imparted hydraulically or electrically by means of a solenoid.

The agitator can be operated continuously, or, as in the best mode, intermittently. In the intermittent mode, the apparatus can be programmed to perform its function at any desired time, with any number of strokes per time interval, by means of a computer or by conventional electrical or electro-mechanical timing devices.

I claim:

1. An electrolytic sodium cell receiver comprising (A) a housing and (B) a device for agitating the contents thereof, the device comprising (1) an agitator havinng (a) a shank portion extending upwardly out of the housing, and (b) a blade portion having a vertical axis central to the housing, the blade portion being closely fitted without the housing and mounted to rotate on said axis, and having three vertically oriented blades projecting laterally and horizontally from said axis in planes which pass vertically through said axis, and spaced about said axis at intervals of about 120°, and (2) means for imparting rotary reciprocal motion to the shank portion in (1) so that the blades move through about 121°–125° of arc.

2. The receiver of claim 1 in which the means in (B) (2) is a crank.

3. The receiver of claim 1 in combination with a computer or an electrical- or electromechanical timing device which directs the agitator device to perform its function at any desired time, with any number of strokes per time interval.

* * * * *

UNITED STATES PATENT OFFICE

CERTIFICATE OF CORRECTION

PATENT NO. : 4,305,671

DATED : DECEMBER 15, 1981

INVENTOR(S) : FRANCIS J. ROSS

It is certified that error appears in the above-identified patent and that said Letters Patent are hereby corrected as shown below:

Column 2, line 50, "out the housing" should be -- in the housing --.

Signed and Sealed this

Ninth Day of March 1982

[SEAL]

*Attest:*

GERALD J. MOSSINGHOFF

*Attesting Officer*

*Commissioner of Patents and Trademarks*